US007576272B2

(12) United States Patent
Houfek

(10) Patent No.: US 7,576,272 B2
(45) Date of Patent: Aug. 18, 2009

(54) MUSIC STAND FOR PIANOS

(76) Inventor: Timothy Houfek, 2464 County Rd. "Q", Prague, NE (US) 68050-6361

( * ) Notice: Subject to any disclaimer, the term of this patent is extended or adjusted under 35 U.S.C. 154(b) by 394 days.

(21) Appl. No.: 11/449,372

(22) Filed: Jun. 8, 2006

(65) Prior Publication Data

US 2006/0283308 A1 Dec. 21, 2006

Related U.S. Application Data

(60) Provisional application No. 60/691,906, filed on Jun. 17, 2005.

(51) Int. Cl.
*G10C 3/02* (2006.01)

(52) U.S. Cl. ..... 84/180

(58) Field of Classification Search ..... 84/180, 84/181, 423 R, 486
See application file for complete search history.

(56) References Cited

U.S. PATENT DOCUMENTS 556,064 A 3/1896 Pepper
2,105,739 A * 1/1938 Jacobs et al. ..... 84/180
6,491,277 B1 12/2002 Chappell et al.

* cited by examiner

*Primary Examiner*—Kimberly R Lockett
(74) *Attorney, Agent, or Firm*—Suiter Swantz pc llo

(57) ABSTRACT

An improved music stand for upright pianos includes a forwardly extending base plate and a back plate extending generally perpendicular to the base plate upwards therefrom. A rear rail-engaging plate extends rearwards from the back plate and the base plate, the rail-engaging plate having an arcuate cross-section curvature operative to fit over and frictionally engage at least a portion of the piano rail on the upright piano whereby the improved music stand is removably supported on the upright piano.

14 Claims, 2 Drawing Sheets

MUSIC STAND FOR PIANOS

CROSS-REFERENCE TO RELATED PROVISIONAL PATENT

This application claims priority based on a provisional patent, specifically on the Provisional Patent Application Ser. No. 60/691,906 filed Jun. 17, 2005.

BACKGROUND OF THE INVENTION

1. Technical Field

The present invention relates to music stands for pianos and, more particularly, to an improved music stand for mounting on an upright piano which includes a forwardly extending base plate, a back plate extending generally perpendicular to the base plate upwards therefrom and a rear rail-engaging plate extending rearwards from the back plate and base plate, the rail-engaging plate having an arcuate cross-section curvature to frictionally engage the piano rail on the upright piano thus providing an improved support structure for sheet music.

2. Description of the Prior Art

Upright or studio pianos are popular for many different reasons, including the fact that they do not occupy a large floor space yet produce a vibrant piano sound. They are popular for teaching piano lessons as well as for being used in size-limited performance spaces. In general, upright pianos include an area above the keyboard which is used as a music stand to support sheet music for the piano player. To retain the sheet music on the upright piano, the majority of upright pianos also include a raised rail which extends parallel to the keyboard in front of the body of the upright piano such that sheet music may be placed against the upright portion of the piano and be prevented from sliding forwards by the sheet music piano rail. However, the use of this rail is not always a simple matter as the sheet music tends to collapse downwards and fall into an unviewable position and further, due to the relatively small size of the sheet music piano rail, the turning and repositioning of the pages of sheet music can be made quite difficult. There is therefore a need for an improved sheet music stand for use with an upright piano which addresses and solves many of the problems not solved by the sheet music piano rail.

Several devices have been proposed in the prior art which attempt to address and correct these deficiencies found in connection with the sheet music piano rail of the upright piano. These include such devices as Pepper, U.S. Pat. No. 556,064 and Chappell et al., U.S. Pat. No. 6,491,277. Each of these devices attempt to improve upon the piano rail previously used for supporting sheet music, but they do not fully address and correct the problems encountered in displaying and using sheet music, particularly in that the Pepper device is only useable with one particular kind of sheet music stand which is found on only a very small number of upright pianos and the Chappell device actually provides only an incremental improvement over the standard piano rail in that it simply adds a slightly upwardly tilted base plate which provides only a small improvement over the piano rail in retaining sheet music thereon. There is therefore a need for an improved music stand for upright pianos which provides a relatively large surface for displaying sheet music and which quickly and easily mounts to virtually any upright piano having a sheet music piano rail.

Therefore, an object of the present invention is to provide an improved music stand for upright pianos.

Another object of the present invention is to provide an improved music stand for upright pianos which includes a forwardly extending base plate, a back plate extending generally perpendicular to the base plate upwards therefrom and a rear rail-engaging plate extending rearwards from the back plate and base plate, the rail-engaging plate having an arcuate cross-section curvature to frictionally engage the piano rail on the upright piano thus providing an improved support structure for sheet music.

Another object of the present invention is to provide an improved music stand for upright pianos which is formed out of an acrylic plastic material which is translucent and rigid to enhance the appearance of the piano while still efficiently supporting sheet music thereon.

Another object of the present invention is to provide an improved music stand for upright pianos which may be quickly and easily mounted on the piano rail on the piano when the piano is in use, so that sheet music may be securely and prominently displayed on the improved music stand, and when the piano is not in use, the improved music stand may be quickly and easily removed from the piano merely by disengaging it from the piano rail thereby allowing the appearance of the piano to be unencumbered.

Finally, an object of the present invention is to provide an improved music stand for upright pianos which is relatively simple and inexpensive to manufacture and which is safe, efficient and effective in use.

SUMMARY OF THE INVENTION

The present invention provides an improved music stand for upright pianos includes a forwardly extending base plate and a back plate extending generally perpendicular to the base plate upwards therefrom. A rear rail-engaging plate extends rearwards from the back plate and the base plate, the rail-engaging plate having an arcuate cross-section curvature operative to fit over and frictionally engage at least a portion of the piano rail on the upright piano whereby the improved music stand is removably supported on the upright piano.

The improved music stand for upright pianos as thus described provides a substantial advantage over other music stands found in the prior art. Whereas the majority of music stands require additional mounting devices such as screws or the like to secure them on the piano, the present invention instead utilizes the already existing piano rail to removably mount the music stand on the piano, thus generally eliminating the possibility of damage being done to the piano during installation and removal of the music stand. Furthermore, because the improved music stand provides a relatively large area for support of the sheet music, it provides a significant improvement over those music stands found in the prior art. Also, as the back plate preferably is of a translucent material with a clear color, the natural beauty of the piano can be clearly seen through the music stand, as opposed to the numerous prior art devices found which are opaque and can actually detract from the appearance of the piano. It is therefore seen that the improved music stand for upright pianos of the present invention provides a substantial improvement over those music stand devices found in the prior art.

DESCRIPTION OF THE PREFERRED EMBODIMENT

Figure 1:
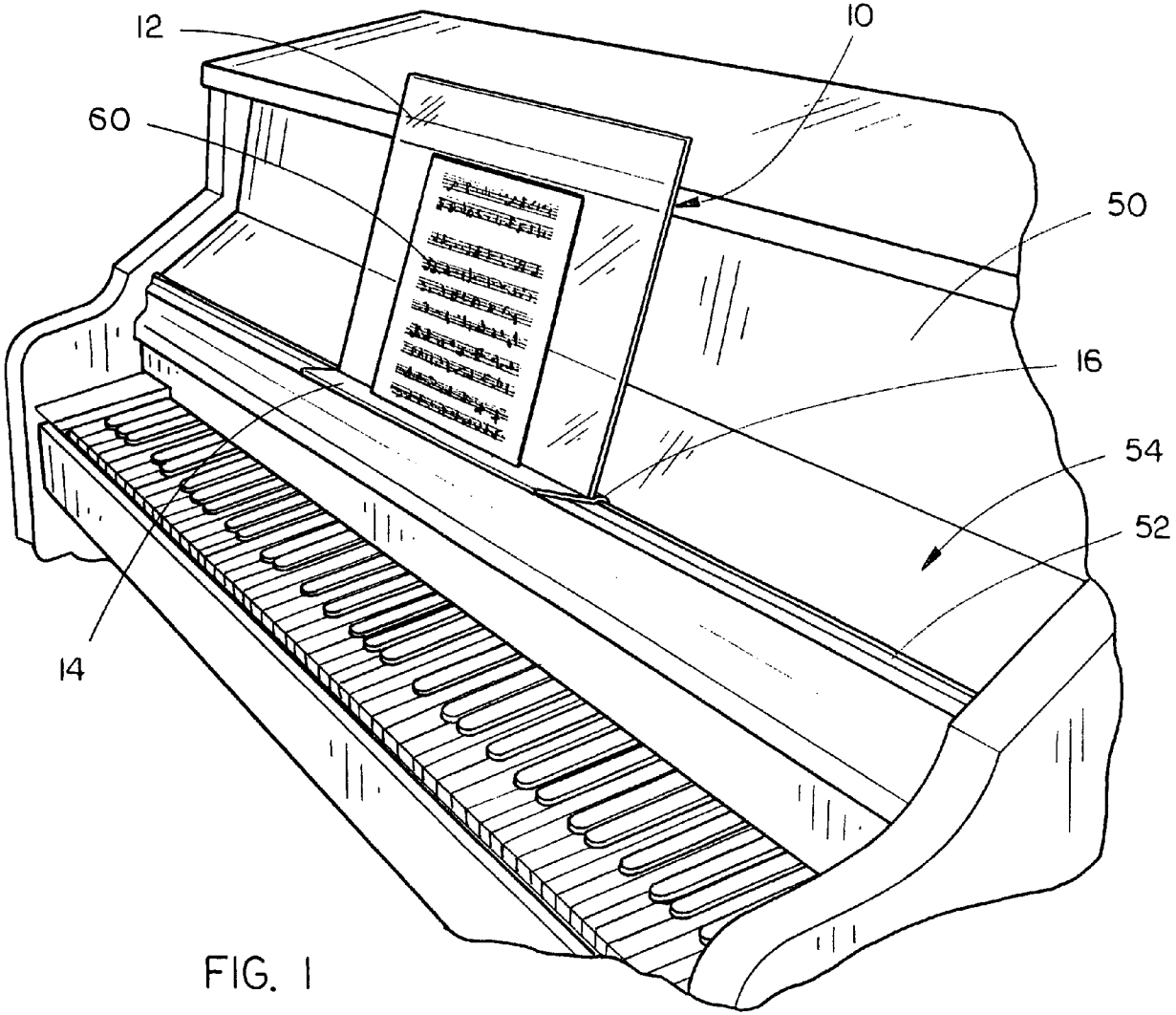
FIG. 1 is a perspective view of the improved piano music stand of the present invention mounted on a piano and supporting sheet music.
Figure 2:
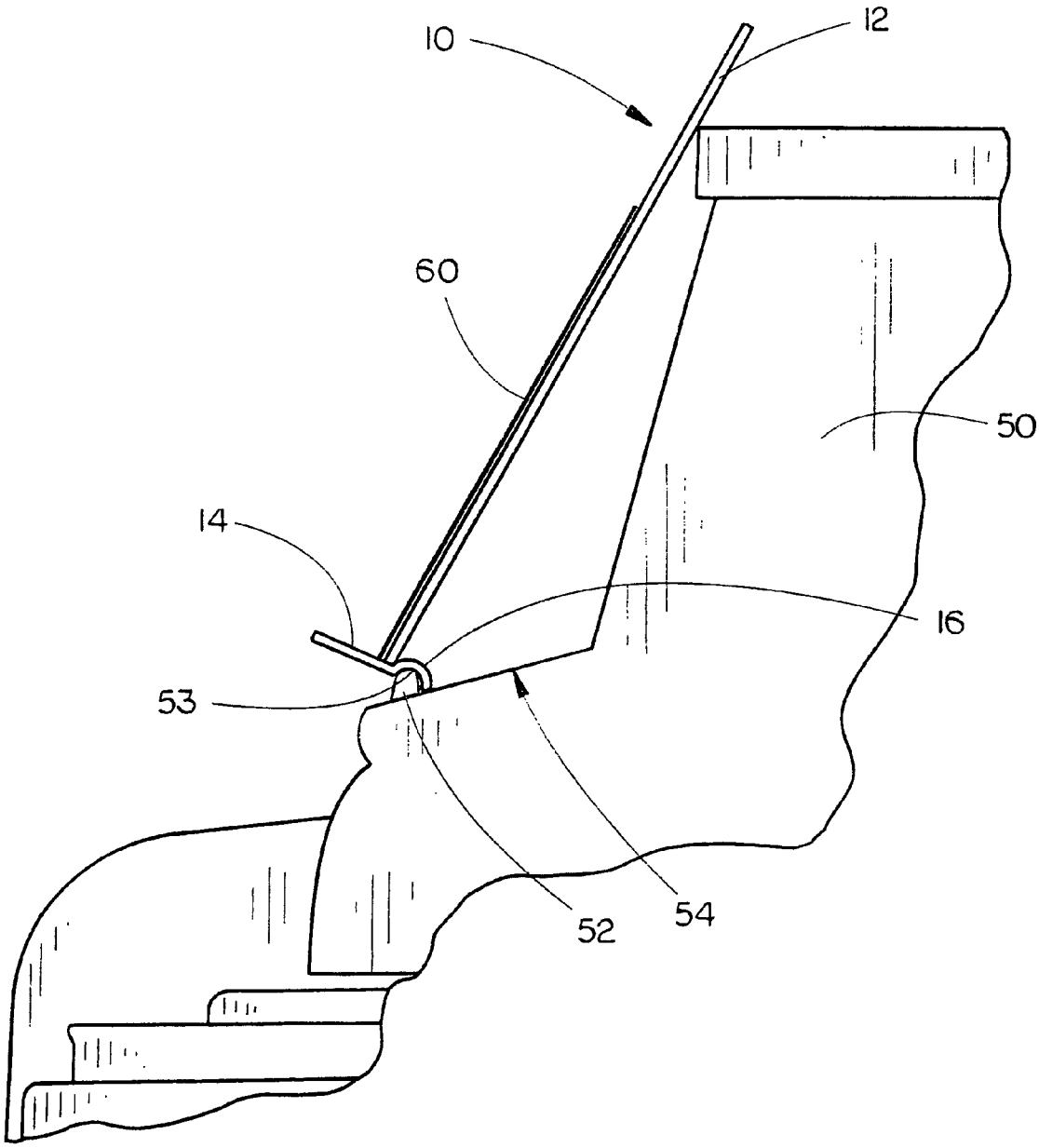
FIG. 2 is a detailed side elevational view of the present invention showing how the rail-engaging plate frictionally engages the piano rail on the upright piano.

The improved music stand 10 of the present invention is shown best in FIGS. 1 and 2 as including three main structural elements, the first being a back plate 12 which, in the preferred embodiment, would be a clear, molded plastic, generally flat plate having a height of approximately 8" to 16", a width of approximately 12" to 24" and a thickness of approximately ⅛" to ¼", depending upon the construction materials used in connection with the back plate 12. Of course, it is not necessary that the back plate 12 have a clear color, as the color and opacity of the back plate 12 is not critical to the present invention. It has been found, however, that when a person has paid a substantial sum of money for a piano, the natural beauty of the piano should be seen, and thus the inclusion of the clear back plate 12 in the present invention is desirable.

Mounted at the base of back plate 12 and extending forwards and outwards therefrom is a base plate 14 which, in the preferred embodiment, would be constructed of the same material as back plate 12 having similar thickness and width, but would have a depth of approximately 1" to 4" depending upon the amount of sheet music intended to be supported by the improved music stand 10 of the present invention and the size of the piano 50 on which the improved music stand 10 is to be mounted. It is also preferred that the base plate 14 be constructed as being clear, although, as was discussed previously, it is not strictly necessary to forsake color and design should such coloration and design imprinting be desirable.

Taken together, the back plate 12 and base plate 14 form a general L-shaped music stand section which provides a relatively large and accessible location on which to display and support sheet music 60, as shown best in FIG. 1. However, the back plate 12 and base plate 14 will not be able to perform their intended functions unless the improved music stand 10 is able to be supported on the piano 50. The support mechanism by which the back plate 12 and base plate 14 are supported on the piano 50 provides the significant inventive element of the improved music stand 10 of the present invention, specifically as it is shown in FIGS. 1 and 2 as the rail-engaging plate 16 which extends rearwards from the base of back plate 12 opposite base plate 14. On the majority of upright pianos 50, a piano rail 52 would extend parallel with the keyboard and be positioned above the keyboard on a shelf 54 or the like, and in general the piano rail 52 would be semi-cylindrical in shape with the rounded top wall 53 of the piano rail 52 engaging the base of the sheet music when the sheet music is placed on the piano 50. When the improved music stand 10 of the present invention is used on the piano 50, rail-engaging plate 16 is designed to frictionally engage the rounded top wall 53 of piano rail 52 as shown best in FIG. 2. To accomplish this, the rail-engaging plate 16 would have an arcuate cross-sectional curvature which approximates the curvature of the rounded top wall 53 of piano rail 52 to provide sufficient frictional contact between the rail-engaging plate 16 and rounded top wall 53 to prevent the improved music stand 10 from sliding of the piano rail 52. As can be seen best in FIG. 2, the rail-engaging plate 16 would have an arch of approximately 60° to 150°, depending upon the amount of frictional contact desired between the rail-engaging plate 16 and piano rail 52 and the particular design of the piano 50 on which the improved music stand 10 is to be mounted. It has been found, however, that an arcuate shape of approximately 90° to 120° provides sufficient frictional contact between the rail-engaging plate 16 and rounded top wall 53 of piano rail 52 to substantially prevent any unintentional sliding or disengagement of the improved music stand 10 from the piano 50. It is thus seen that the arcuate shape of the rail-engaging plate 16 is critical to the proper functioning of the improved music stand 10 of the present invention and therefore constitutes a major portion of the inventive aspects of the present invention.

The use of the improved music stand 10 of the present invention could not be simpler in that one need merely position the rail-engaging plate 16 on the piano rail 52 and lean the back plate 12 rearwards until it contacts the piano 50, as shown in FIG. 1. The arcuate cross-sectional shape of the rail-engaging plate 16 engages the piano rail 52, specifically rounded top wall 53 of piano rail 52, thus preventing the improved music stand 10 from sliding off of the piano 50 and providing a relatively large and easily accessible display area for the sheet music 60. Just as importantly, however, is that the improved music stand 10 of the present invention may be quickly and easily removed from the piano 50 merely by disengaging the rail-engaging plate 16 from the piano rail 52. This might be necessary, for example, in situations where the piano 50 also serves a decorative function and quick and simple removal of the improved music stand 10 of the present invention permits the beauty of the piano 50 to be fully displayed. When it is time to use the piano 50, however, the improved music stand 10 may be quickly and easily replaced on the piano 50 as described above. The improved music stand 10 of the present invention thus provides a substantial improvement over those devices found in the prior art.

It is to be understood that numerous additions, modifications and substitutions may be made to the improved music stand 10 of the present invention which fall within the intended broad scope of the above description. For example, the size, shape and construction materials used in connection with the back plate 12, base plate 14 and rail-engaging plate 16 may be modified or changed so long as the functional features of the improved music stand 10 are neither degraded nor destroyed. Also, it may be desirable to adjust the angle between the base plate 14 and back plate 12 to accommodate various types of pianos 50 to provide a better display area for sheet music 60 positioned thereon and such modifications should be understood to be part of this disclosure. Finally, the exact diameter and curvature of the rail-engaging plate 16 may be modified or changed to accommodate various types of piano rails 52 used on various types of upright pianos, and so long as the rail-engaging plate 16 includes an arcuate cross-sectional shape, the specific curvature and size of the rail-engaging plate 16 is not critical to the present invention so long as it fulfills its intended purpose of frictionally mounting the improved music stand 10 on the piano 50.

There has therefor been shown and described an improved music stand 10 which accomplishes at least all of its intended purposes.

I claim:

1. An improved music stand for an upright piano comprising:

a forwardly extending base plate;

a back plate extending generally perpendicular to said base plate upwards therefrom;

a rear rail-engaging plate extending rearwards from said back plate and said base plate; and said rail-engaging plate having an arcuate cross-section curvature operative to fit over and frictionally engage at least a portion of a piano rail on the upright piano whereby said improved music stand is removably supported on the upright piano.

2. The improved music stand for upright pianos of claim 1 wherein said arcuate cross-section curvature of said rail-engaging plate comprises an arcuate shape of approximately 60° to 150° thereby providing frictional contact between said rail-engaging plate and a rounded top wall of the piano rail thereby releasably securing the improved music stand on the piano rail.

3. The improved music stand for upright pianos of claim 1 wherein said music stand is constructed of a clear, molded, generally flat plastic plate material.

4. The improved music stand for upright pianos of claim 1 wherein said arcuate cross-sectional shape of said rail-engaging plate is generally semi-cylindrical and extends through an arc of approximately 90° to 1200.

5. The improved music stand for upright pianos of claim 1 wherein said back plate and said base plate are generally rectangular in shape.

6. In combination:

an upright piano having a body, keyboard and a transversely extending piano rail mounted on said body above said keyboard; and an improved music stand for upright pianos including;

a forwardly extending base plate;

an upwardly extending back plate on which said base plate is mounted extending forwardly therefrom;

a rear rail-engaging plate extending rearwards from said back plate and said base plate;

said rail-engaging plate having an arcuate cross-section curvature operative to fit over and frictionally engage at least a portion of said piano rail on said upright piano, said back plate engaging said body of said piano above said piano rail whereby said improved music stand is removably supported on the upright piano via said frictional engagement of said rail-engaging plate with said piano rail.

7. The combination of claim 6 wherein said piano rail of said piano includes a generally transversely rounded top wall.

8. The combination of claim 7 wherein said arcuate cross-section curvature of said rail-engaging plate comprises an arcuate shape of approximately 60° to 150° thereby providing frictional contact between said rail-engaging plate and said rounded top wall of said piano rail thereby releasably securing the improved music stand on said piano rail.

9. The combination of claim 6 wherein said music stand is constructed of a clear, molded, generally flat plastic plate material.

10. The combination of claim 6 wherein said arcuate cross-sectional shape of said rail-engaging plate is generally semi-cylindrical and extends through an arc of approximately 90° to 120°.

11. The combination of claim 6 wherein said back plate and said base plate are generally rectangular in shape.

12. An improved music stand for upright piano comprising:

a forwardly extending base plate;

an upwardly extending back plate on which said base plate is mounted extending forwardly therefrom;

a rear rail-engaging plate extending rearwards from said back plate and said base plate; and said rail-engaging plate having an arcuate cross-section curvature having an arc of approximately 600 to 150' and being operative to fit over and frictionally engage at least a portion of a piano rail on the upright piano whereby said improved music stand is removably supported on the upright piano.

13. The improved music stand for upright pianos of claim 12 wherein said music stand is constructed of a clear, molded, generally flat plastic plate material.

14. The improved music stand for upright pianos of claim 12 wherein said arcuate cross-sectional shape of said rail-engaging plate is generally semi-cylindrical and extends through an arc of approximately 90° to 1200.

* * * * *